US008373733B2

(12) United States Patent
Yamada

(10) Patent No.: US 8,373,733 B2
(45) Date of Patent: Feb. 12, 2013

(54) THERMAL PRINTER

(75) Inventor: Rikuo Yamada, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 268 days.

(21) Appl. No.: 12/839,898

(22) Filed: Jul. 20, 2010

(65) Prior Publication Data

US 2011/0050831 A1 Mar. 3, 2011

(30) Foreign Application Priority Data

Aug. 31, 2009 (JP) ..... 2009-199480

(51) Int. Cl.
*B41J 11/00* (2006.01)

(52) U.S. Cl. ..... 347/215

(58) Field of Classification Search ..... 347/216, 347/197, 215; 400/120.16
See application file for complete search history.

(56) References Cited

U.S. PATENT DOCUMENTS

| | | | | |
|---|---|---|---|---|
| 6,736,561 | B2 | 5/2004 | Castelli et al. | |
| 2007/0286659 | A1 * | 12/2007 | Yamada | 400/58 |
| 2008/0024585 | A1 | 1/2008 | Kamata | |
| 2012/0105568 | A1 * | 5/2012 | Yamada | 347/220 |

FOREIGN PATENT DOCUMENTS

| | | | |
|---|---|---|---|
| JP | 06-156808 | A | 6/1994 |
| JP | 2000-318873 | A | 11/2000 |
| JP | 2002-321416 | A | 11/2002 |
| JP | 2005-246906 | A | 9/2005 |
| JP | 2008-30301 | A | 2/2008 |

OTHER PUBLICATIONS

Machine-generated translation of JP 6-506808, published on Jun. 1994.*
Machine-generated translation of JP 2000-318873, published on Nov. 2000.*

* cited by examiner

*Primary Examiner* — Huan Tran
(74) *Attorney, Agent, or Firm* — Nutter McClennen & Fish LLP; John J. Penny, Jr.; Kevin C. McGrath

(57) ABSTRACT

A thermal printer avoids or reduces difficult to correct problems caused by recording paper that has passed the printing position leaving the paper transportation path. A printing mechanism has a head mounting plate that carries a line thermal head, a front guide plate disposed downstream from the head mounting plate, a platen roller that defines the printing position A, and a back guide member disposed downstream from the platen roller. The head mounting plate and front guide plate have interlocking parts that interlock with each other widthwise to the paper transportation path. A paper detector that detects entry of the recording paper 45 is disposed to a gap E between the back guide member and platen roller. When the paper detector detects the recording paper 45, a rotation control unit stops the platen roller.

9 Claims, 6 Drawing Sheets

THERMAL PRINTER

BACKGROUND

1. Technical Field

The present invention relates to a thermal printer that can avoid or reduce paper jams and other problems that are difficult to correct as a result of recording paper leaving the paper transportation path after passing the printing position.

2. Related Art

Recording paper is printed in a thermal printer by pressing the recording paper against a thermal head by means of a platen roller at a printing position located along the paper transportation path. In the thermal printer described in Japanese Unexamined Patent Appl. Pub. JP-A-2008-30301, the thermal head is carried on a head mounting plate that can move to and away from the platen roller, and contact pressure is held between the thermal head and platen roller as a result of the head mounting plate being urged to the platen roller side by a compression coil spring.

After the recording paper passes the printing position in this type of thermal printer, the front surface that was printed on is guided by a front guide member fastened beside the head mounting plate on the downstream side in the transportation direction, the back side is guided by a back guide member fastened beside the platen roller on the downstream side in the transportation direction, and the paper is thus conveyed in the transportation direction to the paper exit. A gap must be provided between the head mounting plate and the front guide member so that there is no interference with the front guide member when the head mounting plate moves. A gap must also be provided between the platen roller and the back guide member so that there is no interference with the back guide member when the platen roller rotates. As a result, the recording paper could enter either of these gaps after passing the printing position and cause a jam at a position outside the paper transportation path where fixing the paper jam is difficult.

SUMMARY

A thermal printer according to the present invention can prevent or reduce the deviation of the recording paper from the paper transportation path after passing the printing position and resulting problems that are difficult to correct.

A first aspect of the invention is a paper transportation path that conveys recording paper passed a thermal head printing position; a platen roller that conveys while pressing the recording paper to the thermal head; a head mounting member that can move the thermal head to and away from the platen roller; a front guide member that is disposed beside the head mounting member on the downstream side in the paper transportation direction and guides a front side of the recording paper through the paper transportation path; a back guide member that is disposed beside the platen roller on the downstream side in the paper transportation direction and guides a back side of the recording paper through the paper transportation path; and a paper detector that detects recording paper entering a gap between the back guide member and the platen roller; the head mounting member and the front guide member having overlapping parts that overlap each other when seen widthwise to the paper transportation path.

In this aspect of the invention the head mounting member and the front guide member have overlapping parts that overlap each other when seen widthwise to the paper transportation path. As a result, even if a gap must be provided between the head mounting member and the front guide member to avoid interference therebetween, this gap is not formed in a straight line widthwise to the recording paper conveyed through the paper transportation path, and the recording paper can therefore be prevented from entering the gap between the head mounting member and the front guide member.

This aspect of the invention also has a paper detector that detects recording paper entering the gap between the back guide member and the platen roller. Therefore, when recording paper enters the gap rendered between the platen roller and the back guide member to avoid interference therebetween, entrance of the recording paper can be detected by the paper detector. If the entry of recording paper to the gap can be detected, entry of the recording paper can be reported to the user by issuing a warning, for example, and the user can take appropriate action such as stopping thermal printer operation. As a result, because the recording paper can be restored to the paper transportation path before the recording paper jams at a position removed from the paper transportation path where recovery can be difficult, recovery is simple.

To prevent entry of the recording paper by the overlapping parts in another aspect of the invention, the overlapping parts are preferably interlocking parts that interlock the head mounting member and the front guide member interlock together widthwise to the paper transportation path.

To more reliably prevent entry of the recording paper by the overlapping parts in another aspect of the invention, the interlocking parts are formed at plural locations widthwise to the paper transportation path.

Further preferably, another aspect of the invention preferably also has a rotation control unit that stops rotation of the platen roller when the paper detector detects the recording paper.

When the recording paper enters the gap between the platen roller and the back guide member in this aspect of the invention, rotation of the platen roller can be stopped before the recording paper jams at a position removed from the paper transportation path and causes a problem that is difficult to correct. Returning the recording paper to the paper transportation path is therefore simple, and the recovery operation is easy.

To return recording paper that has entered the gap between the platen roller and the back guide member to the paper transportation path, the rotation control unit stops rotation of the platen roller and then preferably causes the platen roller to rotate in the opposite direction as the direction before rotation stopped.

To make returning the recording paper to the paper transportation path easy when the recording paper has entered the gap between the platen roller and the back guide member, the platen roller in another aspect of the invention preferably can move to a retracted position separated from the thermal head.

In order to further simplify returning the recording paper to the paper transportation path, the back guide member and the paper detector in according to another aspect of the invention can preferably move in unison with the platen roller, and when the platen roller moves to the retracted position, at least the portion of the paper transportation path downstream from the printing position of the paper transportation path opens.

When the thermal printer also has a cutter for cutting the recording paper in another aspect of the invention, the thermal printer preferably also has a cutter disposed to a cutting position located downstream in the paper transportation direction from the printing position of the paper transportation path. The cutter includes a fixed knife that determines the cutting position and is disposed to a position beside the back guide member on the downstream side in the paper transportation direction, and a movable knife that is located beside the front guide member on the downstream side in the paper transportation direction and can move to and away from the fixed knife. The front guide member has an inclined guide surface that slopes to the fixed knife side toward the cutting position, and guides the recording paper between the fixed knife and the movable knife. In this aspect of the invention, the recording paper traveling through the paper transportation path to the cutting position is guided by the inclined guide surface to the fixed knife side. As a result, when the movable knife moves in the direction away from the fixed knife, pulling the recording paper into the gap between the movable knife and the front guide member can be reduced or avoided.

Yet further preferably, the fixed knife can move to a position separated from the cutting position. This aspect of the invention makes the task of returning the recording paper to the paper transportation path easier when, for example, the recording paper enters the gap between the movable knife and the front guide member.

* Effect of the Invention

In this aspect of the invention the head mounting member and the front guide member have overlapping parts that overlap each other when seen widthwise to the paper transportation path. As a result, even if a gap must be provided between the head mounting member and the front guide member to avoid interference therebetween, this gap is not formed in a straight line widthwise to the recording paper conveyed through the paper transportation path, and the recording paper can therefore be prevented from entering the gap between the head mounting member and the front guide member.

This aspect of the invention also has a paper detector that detects recording paper entering the gap between the back guide member and the platen roller. Therefore, when recording paper enters the gap rendered between the platen roller and the back guide member to avoid interference therebetween, entrance of the recording paper can be detected by the paper detector. If the entry of recording paper to the gap can be detected, entry of the recording paper can be reported to the user by issuing a warning, for example, and the user can take appropriate action such as stopping thermal printer operation. As a result, because the recording paper can be restored to the paper transportation path before the recording paper jams at a position removed from the paper transportation path where recovery can be difficult, recovery is simple.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a thermal printer according to the invention is described below with reference to the accompanying figures.

* General Configuration

Figure 1A:
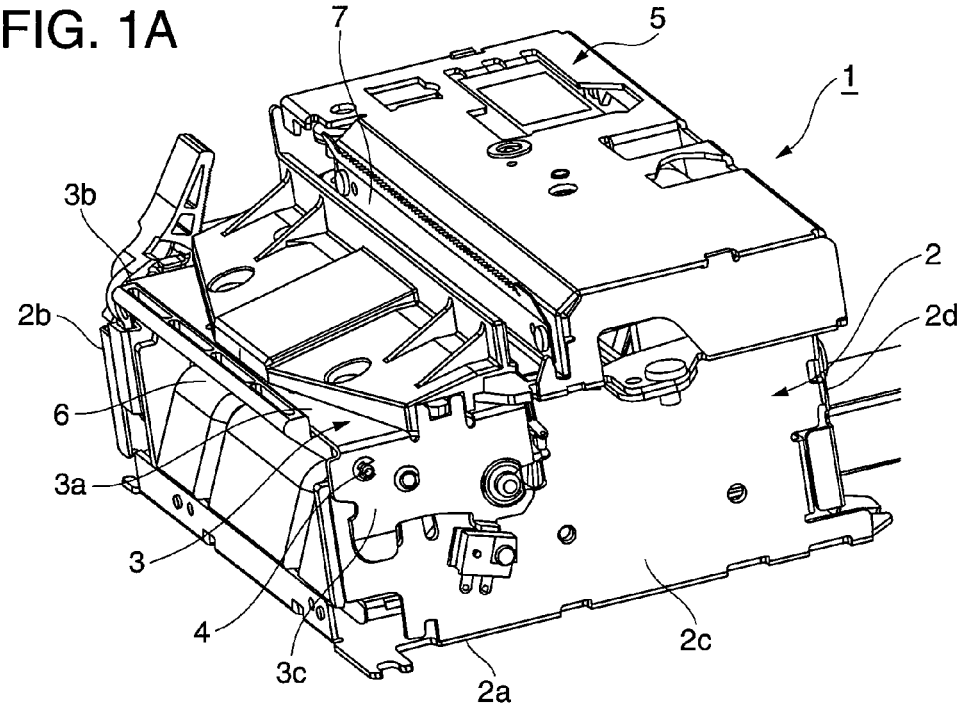
FIG. 1A and FIG. 1B are oblique views of the printing mechanism of a thermal printer according to the invention.
Figure 1B:
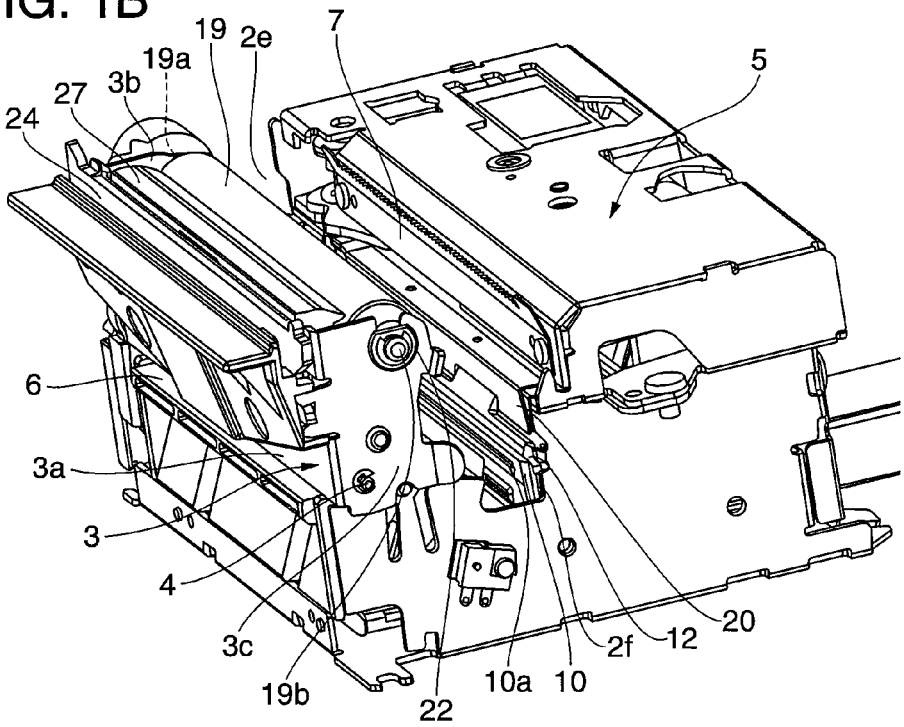
Figure 2A:
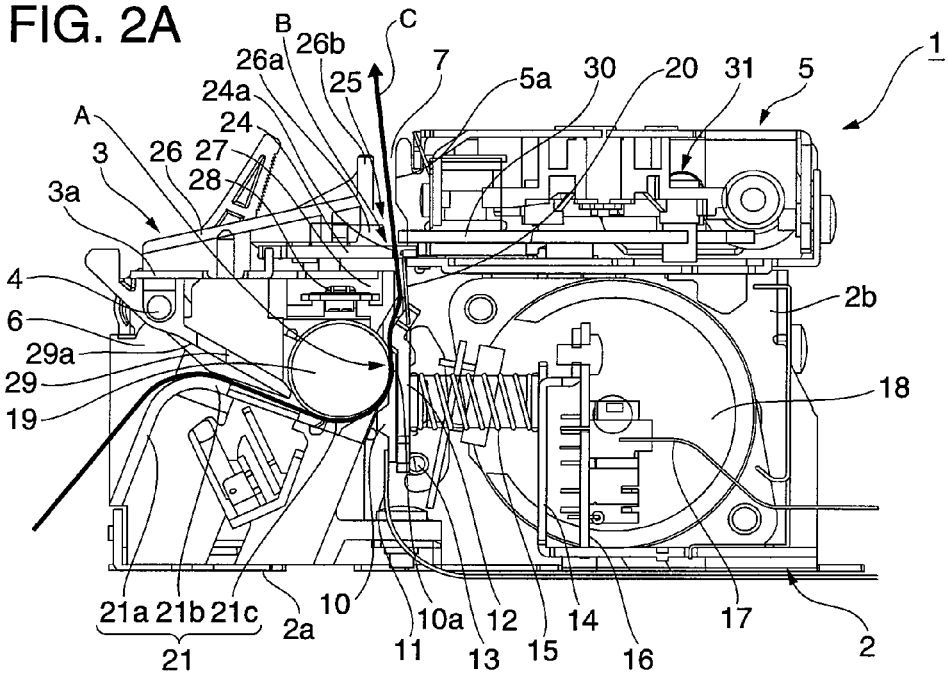
FIG. 2A and FIG. 2B are vertical section views of the printing mechanism shown in FIG. 1.
Figure 2B:
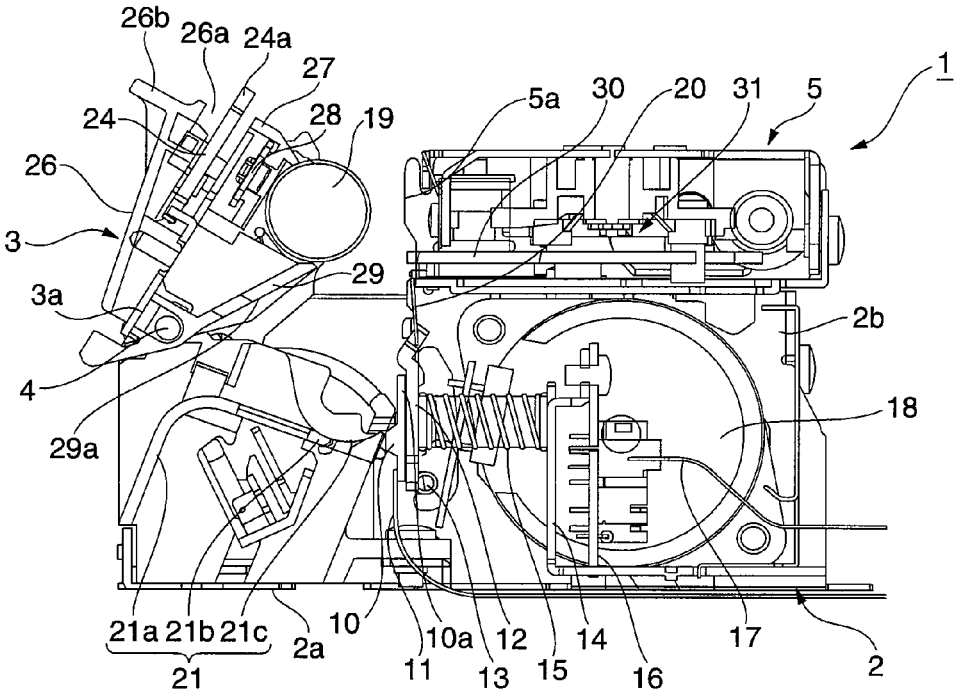

FIG. 1A and FIG. 1B are oblique views of the printing mechanism of a thermal printer according to this embodiment of the invention. FIG. 1A shows the pivot frame in the closed position, and FIG. 1B shows the pivot frame in the open position. FIG. 2A and FIG. 2B are vertical section views of the printing mechanism shown in FIG. 1, FIG. 2A showing the pivot frame closed and FIG. 2B showing the pivot frame open.

As shown in FIG. 1, the printing mechanism 1 has a rectangular printer frame 2 made of sheet metal. The printer frame 2 includes a bottom panel 2*a*, left and right side panels 2*b* and 2*c*, and a back panel 2*d*. A sheet metal pivot frame 3 extends widthwise to the paper frame at the top front part of the printer frame 2.

The pivot frame 3 is supported pivotably on a horizontal shaft 4 that extends widthwise to the printer frame at the front top part of the left and right side panels 2*b* and 2*c* of the printer frame 2, and pivots between a horizontal closed position (see FIG. 1A) covering the top of the printer frame 2, and a closed position (see FIG. 1B) standing upright on top of the printer frame 2. A movable knife unit 5 is disposed at the top back part of the printer frame 2 at a position leaving a slight gap to the pivot frame 3 in the closed position.

A paper inlet 6 for inserting recording paper to the printing mechanism 1 is disposed below the pivot frame 3 at the front of the printer frame 2. A paper exit 7 for discharging the recording paper from the printing mechanism 1 is formed between the pivot frame 3 and the movable knife unit 5 at the top side of the printer frame 2.

As shown in FIG. 2, a line thermal head 10 is disposed to the printer frame 2 below the front end 5*a* of the movable knife unit 5. A flexible printed circuit 11 for supplying drive signals to the line thermal head 10 is connected to the bottom end of the line thermal head 10. The line thermal head 10 is attached to the front of the head mounting plate (head mounting member) 12 disposed behind the line thermal head 10. The bottom end of the head mounting plate 12 is pivotably supported by a support shaft 13 extending horizontally widthwise to the printer frame between the left and right side panels 2*b* and 2*c*, and the head mounting plate 12 can pivot front and back on this support shaft 13. A vertical panel 14 that extends widthwise to the printer frame is disposed behind the head mounting plate 12 with a gap therebetween, and two compression coil springs 15 are disposed between the head mounting plate 12 and the vertical panel 14. These compression coil springs 15 extend between the head mounting plate 12 and vertical panel 14 horizontally in the front-back direction of the printer at positions symmetrical left and right to the width of the head mounting plate 12.

A circuit board 16 is disposed parallel to the vertical panel 14 behind the vertical panel 14. A flexible printed circuit 17 is connected to the circuit board 16.

A paper feed motor 18 is disposed beside the circuit board 16, and this paper feed motor 18 is connected to the left side panel 2*b* of the printer frame 2. A gear case having an internal speed reducing gear train (not shown in the figure) for transferring torque from the paper feed motor 18 to the platen roller 19 is attached to the outside of the left side panel 2*b*.

A front guide plate (front guide member) 20 for guiding the front side, which is the thermal sensitive side, of the recording paper is disposed beside the top of the head mounting plate 12 and extends across substantially the entire width of the printer frame 2.

A first paper insertion guide 21 is attached extending substantially the full width of the printer frame 2 at the front part of the bottom panel 2*a* of the printer frame 2. The first paper insertion guide 21 includes a first inclined guide surface 21*a* that slopes up from the front to the back, a second inclined guide surface 21*b* that slopes down from the top of the first inclined guide surface 21*a* to the back, and a curved guide surface 21*c* that curves up at the back end of the second inclined guide surface 21*b*.

As shown in FIG. 1 and FIG. 2, the pivot frame 3 has a pivot frame top panel 3*a* that covers the top front part of the printer frame 2 in the closed position, and left and right pivot frame side panels 3*b* and 3*c* disposed outside the left and right side panels 2*b* and 2*c* of the printer frame 2.

The platen roller 19 is disposed horizontally widthwise to the pivot frame between the left and right pivot frame side panels 3*b* and 3*c*. The platen shaft ends 19*a* and 19*b*, which extend to the sides from the ends of the platen roller 19, are supported freely pivotably by left and right bearings 22 attached to the pivot frame side panels 3*b* and 3*c*. A follower roller 23 is disposed coaxially to the platen roller 19 on the left side shaft end 19*a*.

Notches 2*e*, 2*f* are formed in front of where the movable knife unit 5 is disposed at the top of the left and right side panels 2*b* and 2*c* of the printer frame 2 as shown in FIG. 1B, and when the pivot frame 3 is set to the closed position, the platen shaft ends 19*a* and 19*b* of the platen roller 19 are positioned in the notches 2*e*, 2*f*.

As shown in FIG. 1A and FIG. 2A, when the pivot frame 3 is closed, the speed reducing gear train and the follower roller 23 are connected, and torque from the paper feed motor 18 can be transferred to the platen roller 19. The platen roller 19 is disposed to a specific position opposite the line thermal head 10, and defines the printing position A of the line thermal head 10. When the platen roller 19 sets the printing position A, the heating element part 10*a* of the line thermal head 10 is pressed by the compression coil springs 15 through the intervening head mounting plate 12 with a specific urging force to the platen roller 19.

A fixed knife 24 extending widthwise to the pivot frame is attached with its cutting edge 24*a* facing the back at the top back side part of the pivot frame top panel 3*a*. The fixed knife 24 and movable knife unit 5 together form an automatic cutter 25. A fixed knife cover 26 is attached to the pivot frame top panel 3*a* so that it covers the top of the fixed knife 24. The fixed knife cover 26 has an open part 26*a* that opens to the back, and the cutting edge 24*a* of the fixed knife 24 is exposed from the open part 26*a*. A rectangular panel 26*b* of a constant height is formed extending across the full width of the pivot frame at the back end of the fixed knife cover 26. When the pivot frame 3 is set to the closed position, the fixed knife 24 determines the cutting position B of the automatic cutter 25, and the rectangular panel 26*b* and front end of the movable knife unit 5 render the paper exit 7.

A back guide member 27 that guides the back side of the recording paper is disposed across substantially the full width of the pivot frame 3 between the platen roller 19 and fixed knife 24. A paper detector 28 is attached to the back guide member 27 at a position opposite the platen roller 19. The paper detector 28 is a reflective photosensor.

A second paper insertion guide plate 29 that has a guide surface 29*a* sloping upward to the front from the platen roller 19 is disposed across substantially the full width of the pivot frame 3 between the platen roller 19 and shaft 4. When the pivot frame 3 is set to the closed position, the second paper insertion guide plate 29 and first paper insertion guide 21 together render the paper inlet 6.

The movable knife unit 5 includes a movable knife 30 that moves to and away from the fixed knife 24, and a movable knife drive mechanism 31 for driving the movable knife 30. The movable knife drive mechanism 31 drives the movable knife 30 forward horizontally from the front end 5*a* of the movable knife unit 5 toward the cutting position B to cut the recording paper.

As shown in FIG. 1B, when the pivot frame 3 is in the closed position, a paper transportation path C is formed from the paper inlet 6 passed the printing position A and then the cutting position B to the paper exit 7.

When the pivot frame 3 is in the open position, the paper transportation path C is open. More specifically, when the pivot frame 3 is set to the open position, the platen roller 19 moves to a position separated from the printing position A. The fixed knife 24 also moves to a position separated from the cutting position B. The paper transportation path C also opens because the back guide member 27 and first paper insertion guide 21 mounted on the pivot frame 3 move in unison with the platen roller 19 and fixed knife 24.

If the paper transportation path C is opened, a web of recording paper supplied from a paper roll, for example, loaded in a paper supply unit not shown is inserted from the paper inlet 6 and drawn between the pivot frame 3 and movable knife unit 5, and the pivot frame 3 is then set to the closed position, the recording paper will be positioned through the paper transportation path C. Once the recording paper is positioned to the paper transportation path C, the platen roller 19 can be driven by driving the paper feed motor 18 and the recording paper can be conveyed through the paper transportation path C. Printing is also possible by driving the line thermal head 10, and cutting the paper is possible by driving the automatic cutter 25.

* Control System

Figure 3:
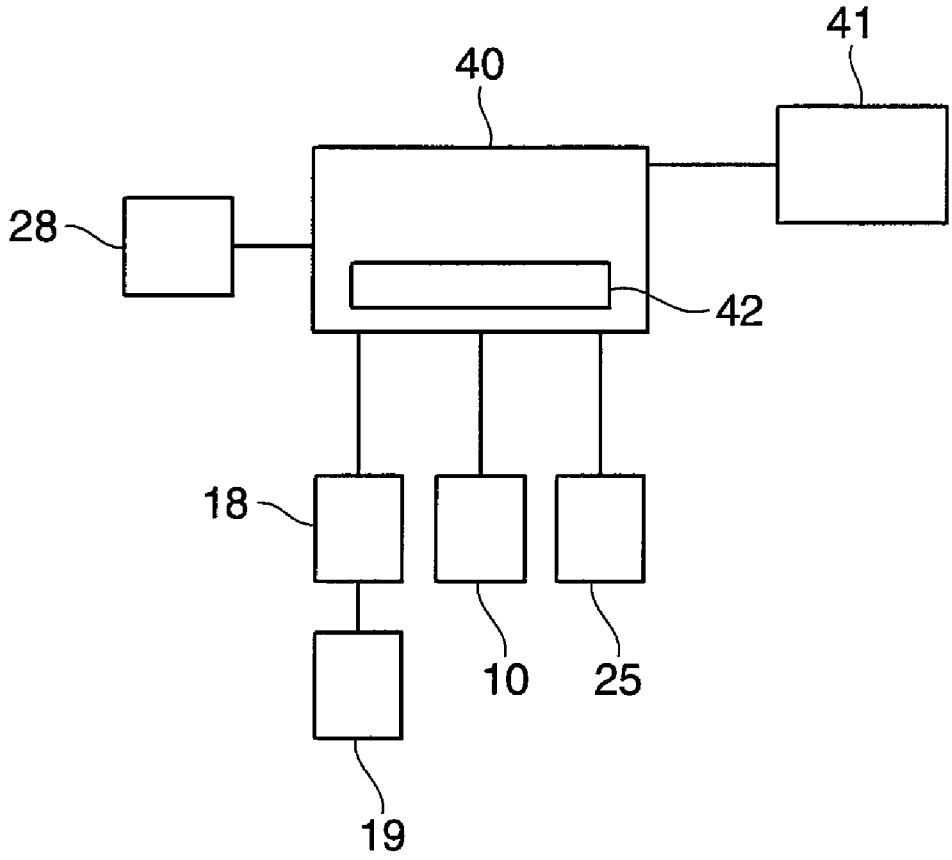
FIG. 3 is a schematic block diagram of the control system of the printer.

FIG. 3 is a schematic block diagram of the control system of a thermal printer. The control system of a thermal printer is centered around a control unit 40 including a CPU, ROM, and RAM, for example. The control unit 40 is disposed in a printer in which the printing mechanism 1 is used.

The control unit 40 is connected to a host device 41, and controls other parts of the thermal printer based on print data and commands received from the host device 41. The control unit 40 conveys recording paper through the paper transportation path C by driving the paper feed motor 18 based on the received print data or command and driving the platen roller 19 rotationally forward. The control unit 40 also drives the line thermal head 10 in conjunction with the recording paper transportation operation to print on the recording paper. The control unit 40 also cuts the recording paper at a specific timing by controlling the automatic cutter 25.

The control unit 40 also has a rotation control unit 42 that stops rotation of the platen roller 19 by stopping rotation of the paper feed motor 18 when the paper detector 28 detects recording paper.

Figure 4:
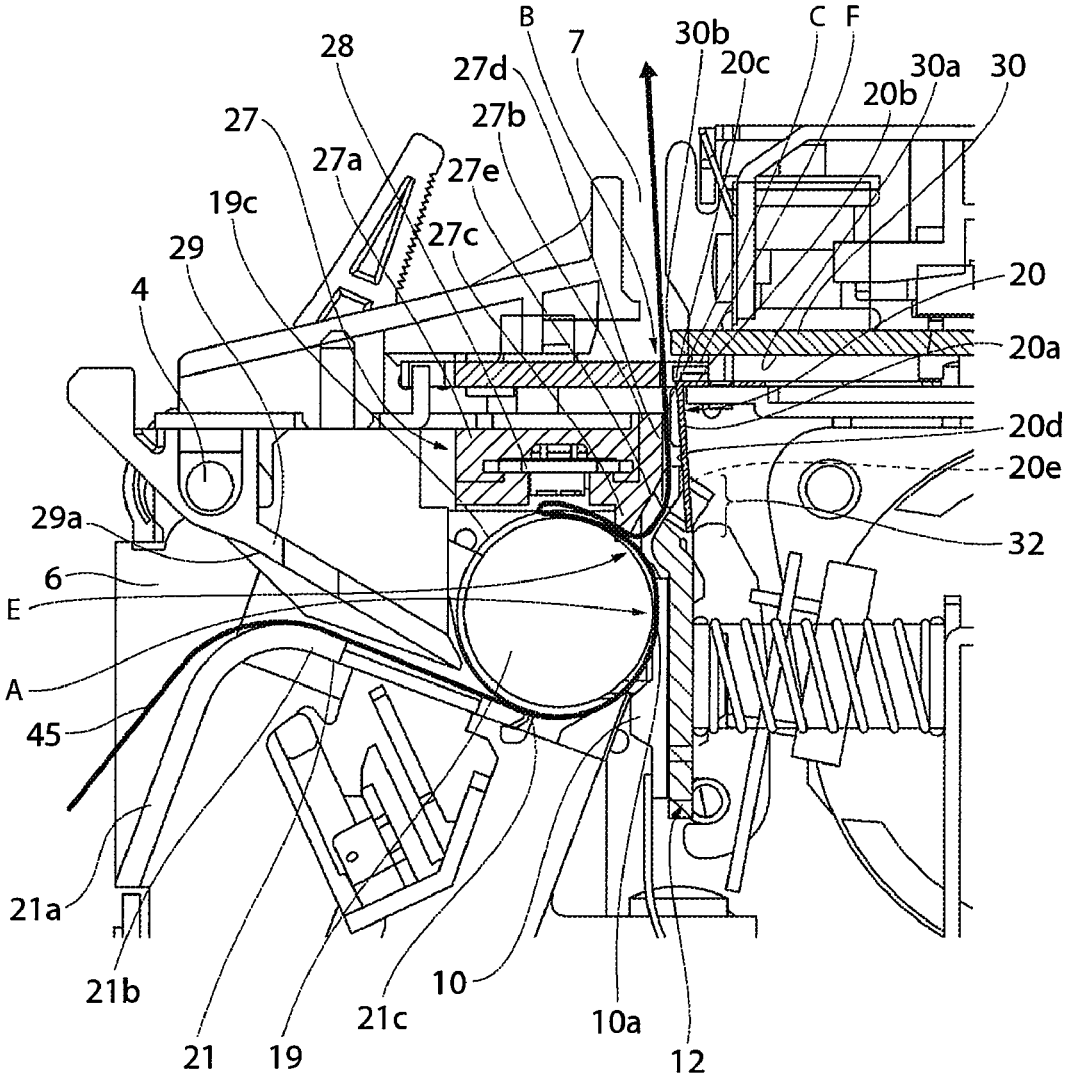
FIG. 4 is an enlarged partial section view of the paper transportation path.
Figure 5A:
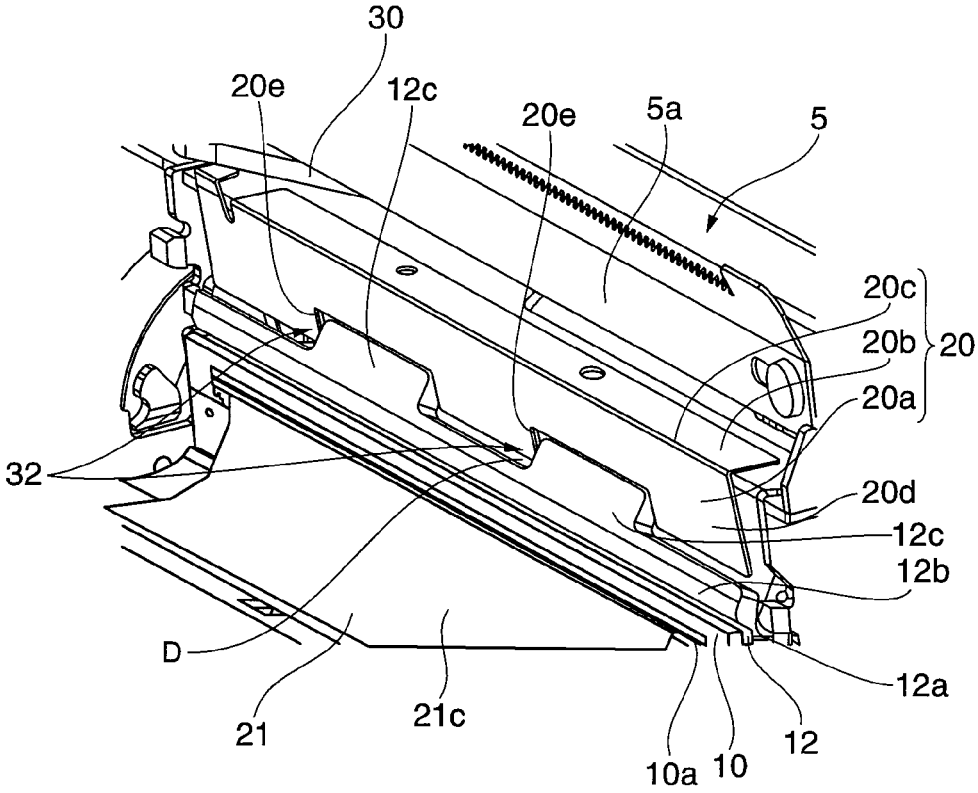
FIG. 5A is an oblique view and FIG. 5B is a front view of the downstream side part of the paper transportation path.
Figure 5B:
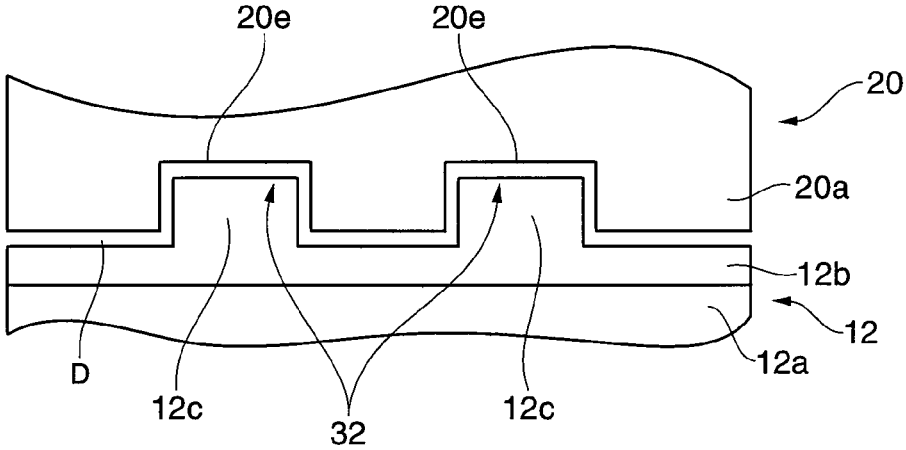

* Configuration of the Paper Transportation Path Downstream in the Paper Transportation Direction from the Printing Position The configuration of the part of the paper transportation path C downstream in the paper transportation direction from the printing position A is described next with reference to FIG. 4 and FIG. 5. FIG. 4 is an enlarged partial section view of the paper transportation path. FIG. 5A is an oblique view from diagonally in front and above the downstream part of the printing position of the paper transportation path when the pivot frame is open. FIG. 5B is a front view from in front of the entrance to the space between the head mounting plate and the front guide plate.

The head mounting plate 12 includes a main mounting panel part 12*a* and a guide part 12*b*. The main mounting panel part 12*a* extends widthwise to the printer frame in a substantially vertical posture when the line thermal head 10 is pressed to the platen roller 19. The guide part 12*b* protrudes slightly forward from the top edge of the main mounting panel part 12*a*, and then slopes up to the back. The line thermal head 10 is disposed to the front of the main mounting panel part 12*a*. The guide part 12*b* touches the outside surface 19*c* of the platen roller 19 and guides the platen roller 19 to the specified position when the pivot frame 3 is closed to the closed position. The guide part 12*b* also guides the recording paper up through the paper transportation path C after passing the line thermal head 10. Two rectangular protruding parts 12*c* that slope up to the back at the same inclination angle as the guide part 12*b* are formed on the top edge of the guide part 12*b* at left and right locations symmetrical to the width of the head mounting plate 12.

The front guide plate 20 disposed adjacent to the top of the head mounting plate 12 (the downstream side in the transportation direction) includes a main guide plate part 20*a* and a guide plate mounting part 20*b*.

The main guide plate part 20*a* extends from the top end of the guide part 12*b* of the head mounting plate 12 to near the bottom end 30*a* of the movable knife 30 of the movable knife unit 5. The guide plate mounting part 20*b* extends horizontally to the back from the top edge of the main guide plate part 20*a*.

The main guide plate part 20*a* slopes forward (to the fixed knife 24 side) toward the cutting position B defined by the fixed knife 24, and a sharp corner part 20*c* at the top end of the main guide plate part 20*a* is positioned near the cutting edge 30*b* of the movable knife 30. The end face of the main guide plate part 20*a* on the paper transportation path C side renders a sloped guide surface 20*d* that guides the recording paper to the fixed knife 24 side between the fixed knife 24 and movable knife 30.

Two notched parts 20*e* corresponding to the rectangular protruding parts 12*c* of the head mounting plate 12 are disposed to the bottom end of the main guide plate part 20*a*. The protruding parts 12*c* of the head mounting plate 12 fit into these notched parts 20*e*. As a result, the head mounting plate 12 and front guide plate 20 have mutually interlocking parts (overlapping parts) 32 extending across the width of the paper transportation path C (the direction perpendicular to the transportation direction). By forming these interlocking parts 32, the gap D rendered between the head mounting plate 12 and front guide plate 20 to prevent interference therebetween has a crank-shaped configuration.

The back guide member 27 disposed beside the top of the platen roller 19 has a horizontal part 27*a* extending horizontally above the platen roller 19, a protruding top part 27*b* that protrudes toward the cutting edge 24*a* of the movable knife 30 from the back edge part of the horizontal part 27*a*, and a protruding bottom part 27*c* that protrudes down toward the outside surface 19*c* of the platen roller 19 from the back side part of the horizontal part 27*a*.

The back guide member 27 is attached to the bottom of the pivot frame top panel 3*a* of the pivot frame 3 so that the protruding top part 27*b* covers the back end of the pivot frame top panel 3*a*. The back end of the back guide member 27 includes a vertical guide surface part 27*d* that extends substantially vertically toward the cutting edge 24*a* of the fixed knife 24, and a sloped guide surface part 27*e* that slopes down to the front from the bottom end of the vertical guide surface part 27*d*. The bottom end of the sloped guide surface part 27*e* is the bottom end of the protruding bottom part 27*c*, and the bottom end of the protruding bottom part 27*c* is disposed opposite the outside surface 19*c* of the platen roller 19 with a narrow gap E therebetween.

The paper detector 28 is disposed to the horizontal part 27*a* in the middle of the width of the printer frame. The paper detector 28 is disposed opposite the outside surface 19*c* of the platen roller 19 not exposed in the paper transportation path C at a position downstream in the transportation direction from the printing position A. The paper detector 28 detects recording paper entering the gap E between the back guide member 27 and platen roller 19 from the paper transportation path C.

* Recording Paper Transportation

When a web of recording paper is loaded into the paper transportation path C and a printing operation is started by the control unit 40, the recording paper part of the recording paper 45 located near the paper inlet 6 is conveyed to the platen roller 19 with the front side guided by the first inclined guide surface 27*e*, and the second inclined guide surface 27*e*, of the first paper insertion guide 21, and the back side guided by the guide surface 29*a* of the second paper insertion guide plate 29. This recording paper part is then conveyed by the platen roller 19 while the front is guided by the curved guide surface 21*c* of the first paper insertion guide 21, and passes the printing position A. At the printing position A, the recording paper is conveyed and printed with the front side pressed by the platen roller 19 against the heating element part 10*a* of the line thermal head 10.

The recording paper that passed the printing position A then travels through the paper transportation path C toward the cutting position B with the printed front side guided by the guide part 12*b* of the head mounting plate 12 and the sloped guide surface 20*d* of the front guide plate 20, and the back guided by the sloped guide surface part 27*e* and the vertical guide surface part 27*d* of the back guide member 27. The paper then passes the cutting position B and is discharged from the paper exit 7. When the printed part of the recording paper passes the cutting position B, the automatic cutter 25 is driven by the control unit 40 and the recording paper 45 is cut at the cutting position B.

Because the head mounting plate 12 and front guide plate 20 have interlocking parts 32 that interlock with each other across the width of the paper transportation path C, the gap between the head mounting plate 12 and front guide plate 20 is shaped like a crank, and the paper transportation path C is not formed in a straight line widthwise to the control unit 40. Therefore, when the recording paper has passed the printing position A and passes between the head mounting plate 12 and front guide plate 20, the paper cannot enter the gap D between the head mounting plate 12 and the front guide plate 20 and will not leave the paper transportation path C.

Because the front guide plate 20 has a sloped guide surface 20*d* that slopes toward the cutting position B to the fixed knife 24 side, the recording paper 45 conveyed toward the cutting position B is guided by the front guide plate 20 toward the fixed knife 24 side. As a result, when the movable knife 30 moves in the direction away from the fixed knife 24 when cutting is completed, pulling of the recording paper 45 into the gap F between the movable knife 30 and the front guide member is reduced or avoided.

In addition, a paper detector 28 is disposed to the back guide member 27 facing the outside surface 19*c* of the platen roller 19 at a position on the back guide member 27 side from the printing position A separated from the paper transportation path C. In addition, the control unit 40 that controls driving the thermal printer has a rotation control unit 42 that stops rotation of the platen roller 19 when the paper detector 28 detects recording paper. If the part of the recording paper 45 that has passed the printing position A enters the gap E between the back guide member 27 and the platen roller 19, the part of the recording paper that entered this gap E is detected by the paper detector 28 and the platen roller 19 therefore stops. As a result, even if the recording paper enters the gap E between the platen roller 19 and the back guide member 27, the recording paper can be easily reset to the paper transportation path C because the platen roller 19 stops before the recording paper can deviate from the paper transportation path C and jam in a way that is difficult to correct.

In addition, because the paper transportation path C also opens if the pivot frame 3 is set to the open position when part of the recording paper 45 enters between the back guide member 27 and the platen roller 19 and the platen roller 19 stops, the recording paper can be easily pulled from the gap E and reset to the paper transportation path C. Yet further, if part of the recording paper 45 is pulled into the gap F between the movable knife 30 and the front guide member, the recording paper can be easily pulled from the gap F and reset to the paper transportation path C if the pivot frame 3 is set to the open position.

* Other Embodiments

The interlocking parts 32 between the head mounting plate 12 and the front guide plate 20 are formed at two locations widthwise to the paper transportation path C in the embodiment described above, but may be rendered at only one location or at three or more locations.

Figure 6:
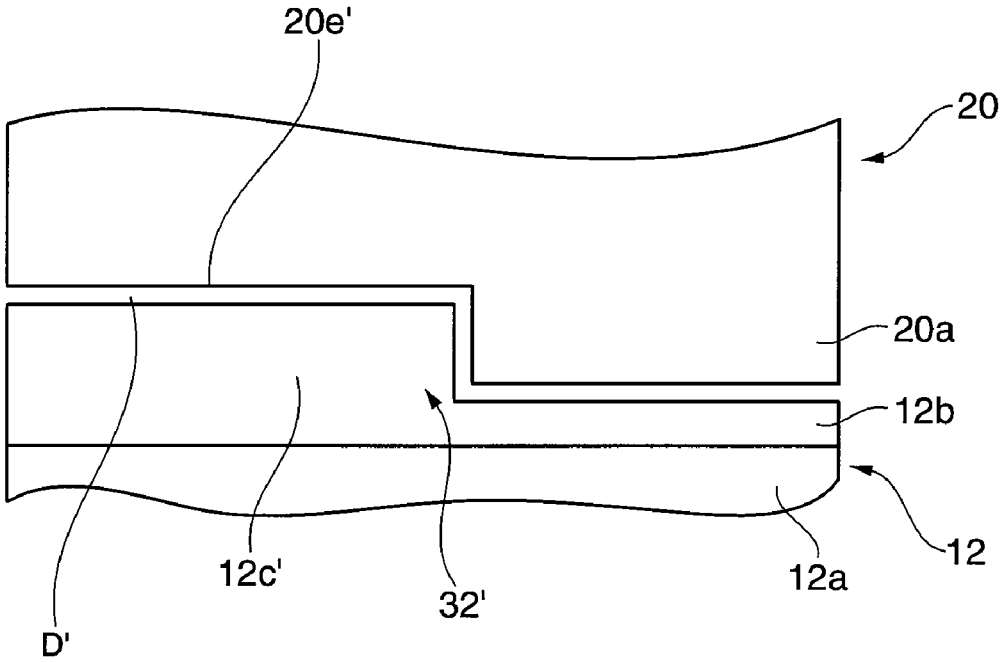
FIG. 6 is a front view of another example of the configuration between the head mounting plate and the front guide member.

The interlocking parts 32 can also be further simplified. FIG. 6 is a front view showing between the head mounting plate and the front guide panel in another embodiment of the invention. In this example, as shown in FIG. 6, a protruding part 12*c*' that projects up from the head mounting plate 12 is formed from one side of the width of the paper transportation path C to the center, and a notched part 20*e*' disposed to the bottom of the front guide plate 20 is formed extending from one side of the width of the paper transportation path C to the center. As a result, the head mounting plate 12 and front guide plate 20 have overlapping parts 32' that overlap each other as seen across the width of the paper transportation path C. Because this configuration also renders a crank-shaped gap D' between the head mounting plate 12 and the front guide plate 20, the part of the recording paper that has passed the printing position A will not enter the gap D' between the head mounting plate 12 and the head mounting plate 12 and leave the paper transportation path C when passing between the head mounting plate 12 and the front guide plate 20.

The rotation control unit 42 in the foregoing embodiment stops rotation of the platen roller 19 when the paper detector 28 detects recording paper, but after stopping the platen roller 19 may also cause the platen roller 19 to rotate in the opposite direction as the direction of rotation before stopping. More specifically, the rotation control means may cause the platen roller 19 to rotate in the opposite direction as the direction of rotation before the platen roller 19 was stopped by reversing the direction of paper feed motor 18 rotation after stopping rotation of the paper feed motor 18. By thus reversing rotation of the platen roller 19, the portion of the recording paper 45 that entered the gap E between the platen roller 19 and the back guide member 27 can be returned to the paper transportation path C.

The control unit 40 may also report when the paper detector 28 detects recording paper by causing an LED disposed to the thermal printer to flash or by sounding a buzzer. Because the user can thus know from this warning that the recording paper left the paper transportation path C, the user can take appropriate action such as stopping operation of the thermal printer. Recovery is thus made easier because the recording paper can be reset to the paper transportation path C before the recording paper 45 jams at a position removed from the paper transportation path where recovery is difficult.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A thermal printer comprising:

a thermal head;

a paper transportation path that conveys recording paper passed a thermal head printing position;

a platen roller that conveys while pressing the recording paper to the thermal head;

a head mounting member that can move the thermal head to and away from the platen roller;

a front guide member that is disposed beside the head mounting member on a downstream side of the head mounting member and guides a front side of the recording paper through the paper transportation path;

a back guide member that is disposed beside the platen roller on a downstream side of the platen roller and guides a back side of the recording paper through the paper transportation path; and a paper detector that detects recording paper entering a gap between the back guide member and the platen roller;

the head mounting member and the front guide member having overlapping parts in a widthwise direction to the paper transportation path.

2. The thermal printer described in claim 1, wherein:

the overlapping parts are interlocking and interlock the head mounting member and the front guide member together widthwise to the paper transportation path.

3. The thermal printer described in claim 2, wherein:

the interlocking parts are formed at plural locations widthwise to the paper transportation path.

4. The thermal printer described in claim 1, further comprising:

a rotation control unit that stops rotation of the platen roller when the paper detector detects the recording paper.

5. The thermal printer described in claim 4, wherein:

the rotation control unit, after stopping rotation of the platen roller, causes the platen roller to rotate in a direction opposite to the direction before rotation stopped.

6. The thermal printer described in claim 1, wherein:

the platen roller can move to a retracted position separated from the thermal head.

7. The thermal printer described in claim 6, wherein:

the back guide member and the paper detector can move in unison with the platen roller; and when the platen roller moves to the retracted position, at least the portion of the paper transportation path downstream from the printing position of the paper transportation path opens.

8. The thermal printer described in claim 1, further comprising:

a cutter disposed to a cutting position located downstream of the printing position of the paper transportation path, the cutter including a fixed knife that determines the cutting position and is disposed to a position beside the back guide member on a downstream side of the back guide member, and a movable knife that is located beside the front guide member on a downstream side of the front guide member and can move to and away from the fixed knife; and the front guide member has an inclined guide surface that slopes to the fixed knife side toward the cutting position, and guides the recording paper between the fixed knife and the movable knife.

9. The thermal printer described in claim 8, wherein:

the fixed knife can move to a position separated from the cutting position.

* * * * *